US007784767B2

(12) United States Patent
Gargaro, III et al.

(10) Patent No.: US 7,784,767 B2
(45) Date of Patent: Aug. 31, 2010

(54) BOAT LIFT DRIVE

(75) Inventors: Nicholas A. Gargaro, III, 6800 Otter Lake Rd., Lino Lakes, MN (US) 55038; David M Wendinger, Isanti, MN (US)

(73) Assignee: Nicholas A. Gargaro, III, Lino Lakes, MN (US)

( * ) Notice: Subject to any disclaimer, the term of this patent is extended or adjusted under 35 U.S.C. 154(b) by 97 days.

(21) Appl. No.: 12/321,816

(22) Filed: Jan. 24, 2009

(65) Prior Publication Data

US 2010/0187488 A1 Jul. 29, 2010

(51) Int. Cl.
*B66D 1/14* (2006.01)

(52) U.S. Cl. ..... 254/343; 254/342

(58) Field of Classification Search ..... 254/343, 254/342

See application file for complete search history.

(56) References Cited

U.S. PATENT DOCUMENTS

| | | | | |
|---|---|---|---|---|
| 2,351,060 | A * | 6/1944 | McLauthlin | 74/425 |
| 3,658,299 | A * | 4/1972 | Sprague | 254/343 |
| 4,613,273 | A * | 9/1986 | Wagner | 414/463 |
| 4,954,011 | A * | 9/1990 | Stenson | 405/3 |
| 5,143,182 | A * | 9/1992 | Basta | 187/261 |
| 5,211,124 | A * | 5/1993 | Reiser | 114/44 |
| 5,284,325 | A * | 2/1994 | Sasaki et al. | 254/274 |
| 5,660,373 | A * | 8/1997 | Maslo et al. | 254/296 |
| 6,767,004 | B1 | 7/2004 | Davis | |
| 7,017,887 | B1 * | 3/2006 | Verakis | 254/342 |
| 7,226,041 | B2 * | 6/2007 | Ledford | 254/342 |
| 7,377,485 | B2 | 5/2008 | Davis | |
| 2007/0200104 | A1 | 8/2007 | Davis | |

* cited by examiner

*Primary Examiner*—Emmanuel M Marcelo

(57) ABSTRACT

A boat lift drive for connection to a winch having a winch shaft. The boat lift drive includes a power unit, a drive train engaged to and being driven by the power unit, and a drive shaft engaged to and being driven by the drive train. The drive shaft in turn is engaged to and drives the winch shaft. The drive shaft includes an interior threaded opening that engages a threaded end of the winch shaft to directly connect the drive shaft to the winch shaft. The drive shaft is further engaged to the winch shaft via a pin that extends through the drive shaft and is threaded into the winch shaft.

6 Claims, 4 Drawing Sheets

BOAT LIFT DRIVE

FIELD OF THE INVENTION

The present invention generally relates to a boat lift drive, particularly to a boat lift drive having a drive shaft directly engaged to the winch shaft at locations that confront the axis of rotation, and specifically to such a boat lift drive having the drive shaft further engaged to the winch shaft via a pin extending through the drive shaft and being threaded into the winch shaft.

BACKGROUND OF THE INVENTION

A boat lift is a mechanism for lifting a boat at least partially out of the water and for securing the boat at a desired location, such as next to a dock. A boat lift mechanism may include a winch.

A winch is a mechanism that winds up or winds out a cable or tether or rope or wire to draw in or draw up or lift up or let out an object at the distal end of the cable. A winch may be hand powered, electric powered, hydraulically powered, pneumatically powered, powered by an internal combustion engine, or powered in some other fashion. A winch may include a mechanism to prevent reverse action of the winch (a winding out) and such a mechanism may be a ratchet and pawl, a solenoid brake, or a mechanical brake.

As indicated, a winch may be hand powered. These hand powered winches may have a hand wheel. Between the hand wheel and the winch, these hand powered winches may further have a winch shaft. When the hand wheel is removed from the winch shaft, an end of the winch shaft is exposed. The end of the winch shaft may include an exterior threaded portion and an interior threaded portion. The interior threaded portion may be a threaded opening that is coaxial with the exterior threaded portion and the winch shaft.

SUMMARY OF THE INVENTION

A feature of the present invention is the provision in a boat lift drive, of the step of identifying an end of a winch shaft to have an exterior threaded portion, and of the step of utilizing the exterior threaded portion to directly engage thereto a boat lift drive.

Another feature of the present invention is the provision in a boat lift drive, of the step of identifying an end of a winch shaft to have an interior threaded portion, and of the step of utilizing the interior threaded portion to engage thereto a boat lift drive.

Another feature of the present invention is the provision in a boat lift drive, of the step of identifying an end of a winch shaft to have an exterior threaded portion and an interior threaded portion that is coaxial with the exterior threaded portion, and of the step of utilizing each of the exterior threaded portion and interior threaded portion to engage thereto a boat lift drive.

Another feature of the present invention is the provision in a boat lift drive, of a power unit, a drive train engaged to and being driven by the power unit, and a drive shaft engaged to and being driven by the drive train, and of the drive shaft being engaged to and driving the winch shaft where the drive shaft includes an interior threaded opening that engages an exterior threaded portion of an end of a winch shaft.

Another feature of the present invention is the provision in a boat lift drive, of a power unit, a drive train engaged to and being driven by the power unit, and a drive shaft engaged to and being driven by the drive train, of the drive shaft including a through opening, and of a pin extending through the through opening and tying into the end of the winch shaft to further tie the drive shaft to the winch shaft.

Another feature of the present invention is the provision in a boat lift drive, of a power unit, a drive train engaged to and being driven by the power unit, and a drive shaft engaged to and being driven by the drive train, of the drive train including a rotatable gear, and of the drive shaft being fixed to the rotatable gear and rotating with the rotatable gear when the rotatable gear is driven in each of the forward and reverse directions.

Another feature of the present invention is the provision in a boat lift drive, of a power unit, a drive train engaged to and being driven by the power unit, and a drive shaft engaged to and being driven by the drive train, of the drive train including a rotatable gear, of the drive shaft being fixed to the rotatable gear and rotating with the rotatable gear when the rotatable gear is driven in each of the forward and reverse directions, and of the drive shaft being threadable into and out of the rotatable gear.

Another feature of the present invention is the provision in a boat lift drive, of a power unit, a drive train engaged to and being driven by the power unit, and a drive shaft engaged to and being driven by the drive train, of the drive train including a rotatable gear, of the drive shaft being fixed to the rotatable gear and rotating with the rotatable gear when the rotatable gear is driven in each of the forward and reverse directions, and of the rotatable gear being fixed to the drive shaft between a head of the drive shaft and a nut threaded onto the drive shaft.

An advantage of the present invention is a direct bite between a drive shaft of a boat lift drive and a winch shaft of a winch.

Another advantage of the present invention is a further engagement of the drive shaft to the winch shaft by a pin.

Another advantage of the present invention is an engagement between the drive shaft and the winch shaft at a position as close to the axis of rotation as possible. If engagement between the drive shaft and winch shaft is spaced at a great distance from the axis of rotation, a relatively little amount of power from the drive unit may drive the winch; however, it may take a relatively great amount of time to wind up the winch. If engagement between the drive shaft and winch shaft is at a location that is as close to the axis of rotation as possible a relatively great amount of power from the drive unit may be required; however, it may take a relatively little amount of time to wind up the winch.

DETAILED DESCRIPTION

Figure 1A:
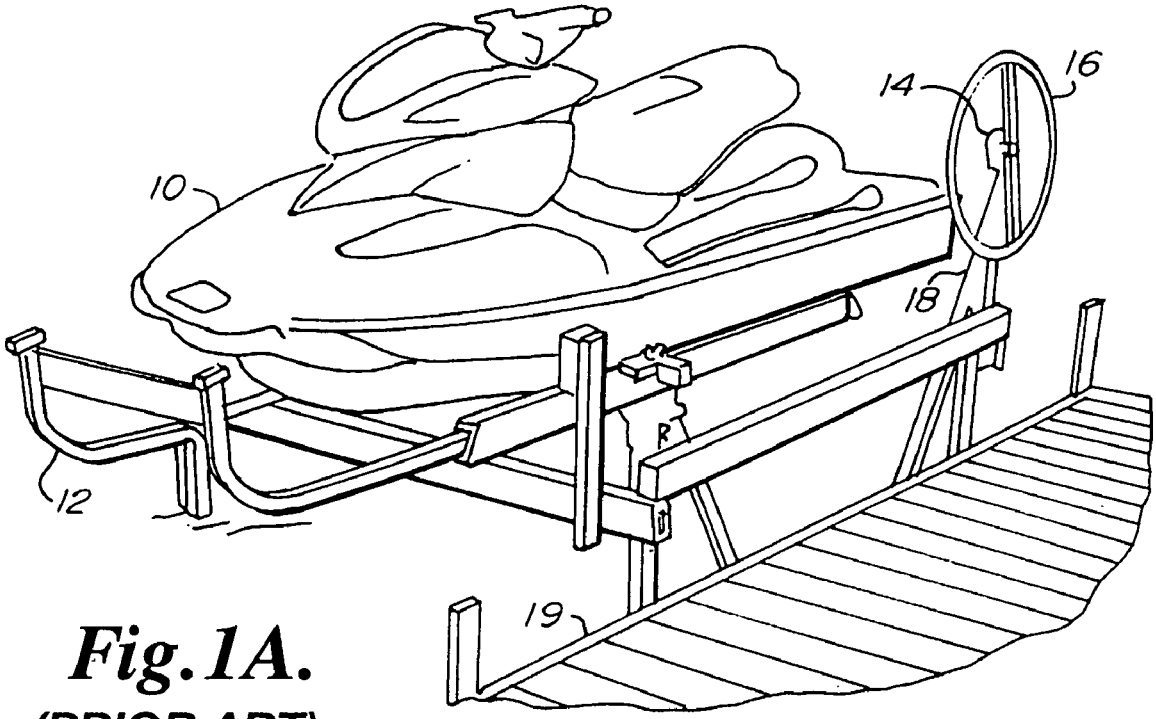
Fig.1A. (PRIOR ART)
FIG. 1A (prior art) is a perspective view of a boat, a boat lift, a dock and a winch driven by a hand wheel.

FIG. 1A shows a boat 10 on a boat lift 12. A portion of the boat lift 12 is released into the water and drawn out of the water by a winch 14 operated by a hand wheel 16. A winch frame 18 supports the winch 14, and the winch frame 18 in turn may be supported by a dock 19 and/or portions of the boat lift 12. Portions of the boat lift 12 may be fixed and supported by one or more of the winch frame 18 and dock 19 and other portions of the boat lift 12 are movable, slideable or liftable relative to the portions of the boat lift 12 that are fixed. A cable extends between the winch 14 and portions of the boat lift 12 that are movable, slideable or liftable, and a pulley system may engage the cable between the winch 14 and the portions of the boat lift 12 that are movable, slideable or liftable. Winch 14 may include a spool upon which the cable is wound up and from which the cable is wound out. The spool of the winch 14 is turned by turning the hand wheel 16.

Figure 2:
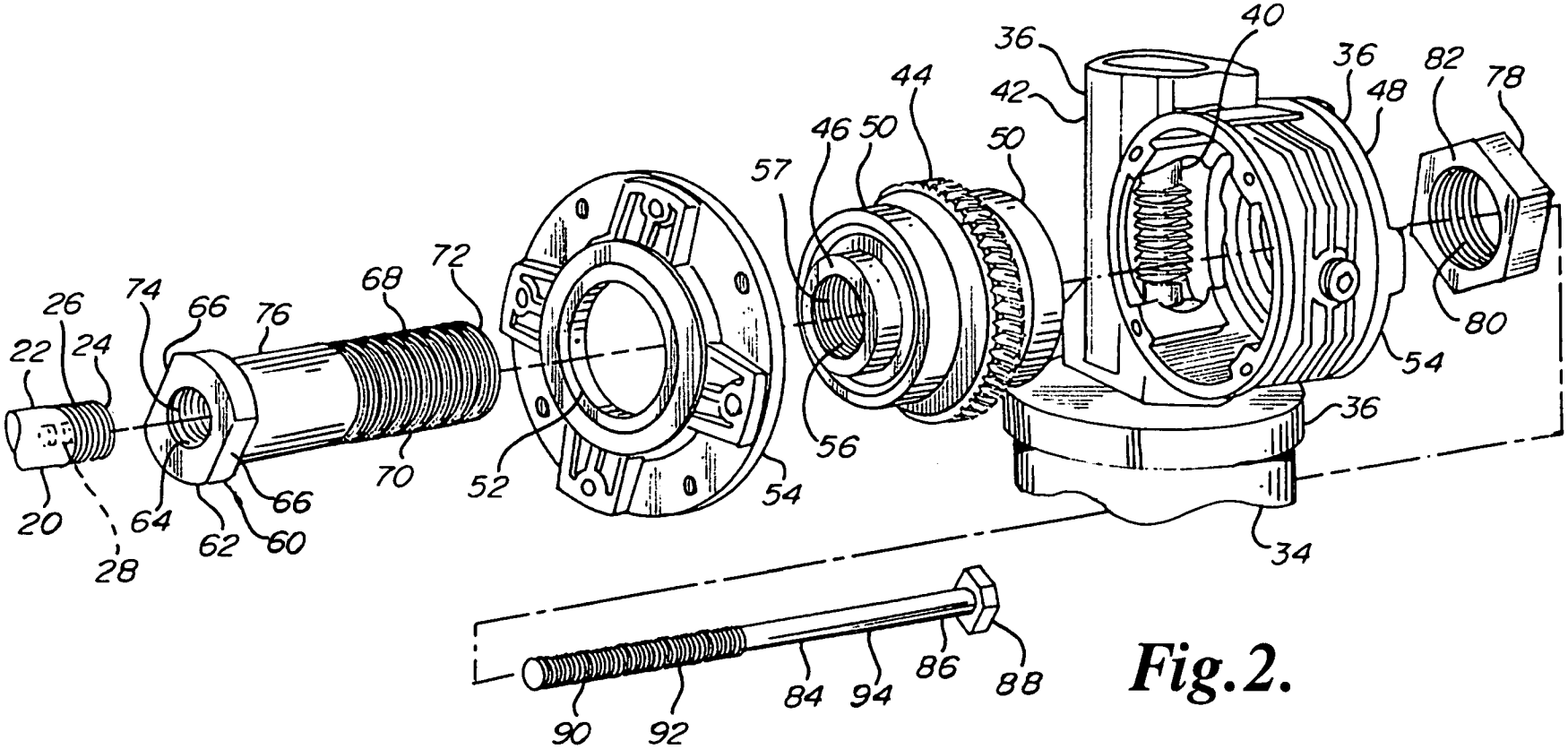
FIG. 2 is a perspective exploded view that shows portions of the boat lift drive of FIG. 1B including a drive train, drive shaft, and locking pin, and that further shows the end of a winch shaft having an exterior threaded portion and an interior threaded portion.

The hand wheel 16 of the winch 14 of FIG. 1A may be removed. Upon removal of the hand wheel 16, a winch shaft 20 is exposed. As shown in FIG. 2, winch shaft 20 includes a winch shaft end 22 having an end face 24. Winch shaft end 22 includes an exterior threaded portion 26 and an interior threaded portion or threaded hole 28. Threaded hole 28 has an opening in the end face 24. Exterior threaded portion 26 and interior threaded portion or hole 28 are coaxial with each other and the winch shaft 20.

Figure 1B:
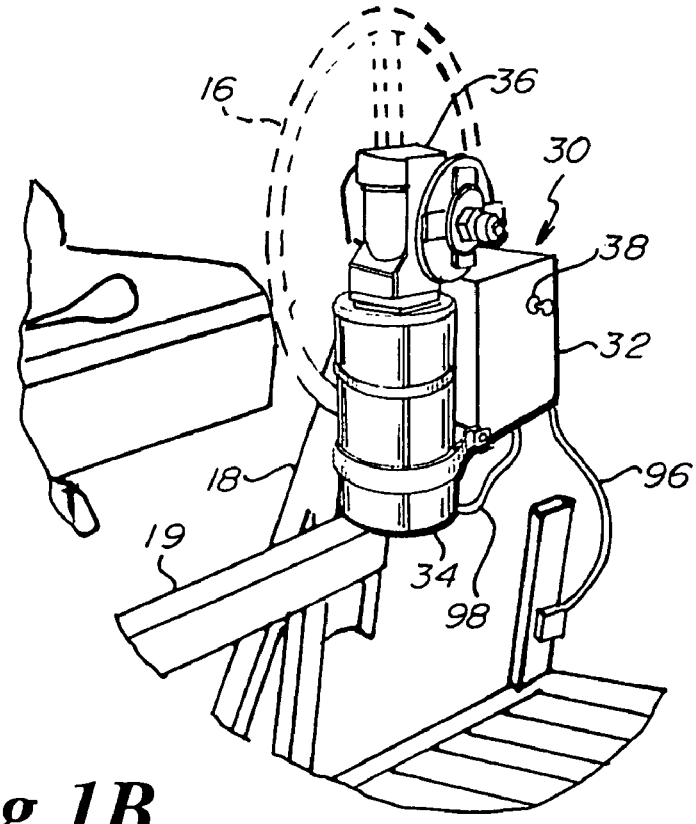
FIG. 1B is a perspective environmental view of the present boat lift drive on the winch of FIG. 1A where the hand wheel of the winch has been removed.

As shown in FIG. 1B, the present boat lift drive is indicated by reference numeral 30. Boat lift drive 30 includes a control unit 32, a power unit 34, and a gear assembly or gear unit 36. Boat lift drive 30 is fixed in place by brackets or bands or other connections to one or more of winch frame 18, dock 19, and the winch shaft 20 itself. Such brackets, bands, or other connections can engage one or more of the control unit 32, power unit 34 and gear unit 36. The control unit 32 includes a key mechanism 38 that turns the boat lift drive 30 on and off and that further controls the direction or rotation of winch 14 such that the key mechanism 38 controls whether the boat 10 is lowered into the water or drawn out of the water.

FIG. 2 shows the gear assembly or gear arrangement or gear unit 36 in exploded fashion. The gear unit 36 includes a worm 40 journaled in a worm housing 42. Worm 40 is engaged to and driven by a power shaft 107 in the power unit 34 in either of the directions of rotation. Power unit 34 includes an electric motor that drives the power shaft 107 that drives the worm 40. Worm 40 and the power shaft 107 can be coaxial and one-piece and integral with each other. Or, if desired, worm 40 and the power shaft 107 can have therebetween a gear arrangement.

Worm 40 in turn drives a worm gear or worm wheel or rotatable gear 44 in either of the directions of rotation. Worm gear 44 is one-piece and integral with a cylindrical like core 46 such that rotation of worm gear 44 drives core 46 and such that rotation of core 46 drives worm gear 44. Worm gear 44 and core 46 are coaxial. Worm gear 44 and core 46 are journaled in a worm gear housing 48 via a pair of bearings 50. The bearings 50 may have rollers or balls therein as rolling elements. Each of the ends of the core 46 confront an annular sealing gasket 52. Each of the annular sealing gaskets is set in a disk like end 54 of worm gear housing 48. Core 46 includes two open ends and each of the open ends includes an interior threaded portion 56. Worm gear 44 includes a through opening 57 that runs through the core 46.

Worm gear 44 in turn drives a drive shaft 58 in either of the directions of rotation. Drive shaft 58 is in the form of a bolt. Drive shaft 58 may be referred to as an adapter. Drive shaft 58 includes a first end 60 that includes a head 62 and a threaded interior portion 64. Threaded interior portion 64 engages the exterior threaded portion 26 of the winch shaft end 22. Threaded interior portion 64 may be a self-locking by having nylon inserts or threads that are somewhat or slightly oval-shaped to provide a secure and locking bite to the winch shaft end 22 such that drive shaft 58 turns winch shaft end 22 in either of the directions of rotation. The head 62 includes flats 66 extending in the axial direction and extending parallel to each other for engaging a tool such as a wrench. Drive shaft 58 includes a second end 68, an exterior threaded portion 70 leading from the second end 68, and an end face. Exterior threaded portion 70 engages the interior threaded portions 56 of the ends of the core 46. Drive shaft 58 includes a through opening 74 formed in part by interior threaded portion 64 at the first end 60 of the drive shaft 58. Through opening 74 exits the first end 60 via the interior threaded portion 64. Through opening 74 exits the second end 68 through face 72, as shown in FIGS. 3C and 3D. Through opening 74 is coaxial with drive shaft 58, interior threaded portion 64, exterior threaded portion 68, core 46, through opening 57, interior threaded portion 56, bearings 50, worm gear 44, winch shaft 20, winch shaft end 22, exterior threaded portion 26, and interior threaded portion 28. Drive shaft 58 further includes a cylindrical portion 76 extending from the head 62 to the exterior threaded portion 70. Each of cylindrical portion 76 and exterior threaded portion 70 extends about one-half of the length of drive shaft 58.

Boat lift drive 30 further includes a hardware fastener such as a nut 78 to mate with drive shaft 58 to lock the drive shaft 58 to the worm gear 44 such that the worm gear 44 drives the drive shaft 58 in either of the directions of rotation. Nut 78 includes an interior threaded portion 80. Nut 78 is a hexagonal nut. Nut 78 may be a self-locking nut by having nylon inserts or threads that are somewhat or slightly oval-shaped. Nut 78 further includes a face 82 that confronts and brings pressure to bear upon core 46 of worm gear 44 such that the worm gear 44 is locked between the head 62 of the drive shaft 58 and the nut 78 of the drive shaft 58. The head 62 confronts the core 46 on one side of the worm gear 44 and the nut 78 confronts the core 46 on the other side of the worm gear 44. A washer, if desired, may be placed between head 62 and core 46. Another washer, if desired, may be placed between nut 78 and core 46.

Boat lift drive 30 further includes a pin 84 to further engage the drive shaft 58 to the winch shaft end 22. Pin 84 includes a first end 86 that includes a head 88 that confronts the face 72 of drive shaft 58. Pin 84 includes a second end 90 that includes an exterior threaded portion 92 that engages the interior threaded portion 28 of winch shaft end 22. Pin 84 extends through the through opening 74 of drive shaft 58 and provides, in addition to the bite provided by threads 64 of drive shaft 58 and threads 26 of winch shaft end 22, a further engagement of the drive shaft 58 to the winch shaft end 22. Pin 84 is a lock or a safety lock that locks the drive shaft 58 to the winch shaft end 22. Interior threaded portion 28 may be remanufactured to be self-locking with the inclusion of nylon inserts or by re-threading the threads 28 to be somewhat or slightly oval-shaped. Exterior threaded portion 92 may have a length of about one inch or may extend a greater length over the end or end portion 90 of pin 84. Pin 84 includes a cylindrical portion extending to and between threads 92 and head 88. As shown in FIG. 3D, a washer 95 may be disposed between pin head 88 and the end face 72 of the drive shaft 58. Washer 95 may be a locking washer, such as a split-ring lockwasher, a Belleville washer (a nonflat washer with a cupped spring shape or slight conical shape), or a star-shaped lock washer.

Figure 3A:
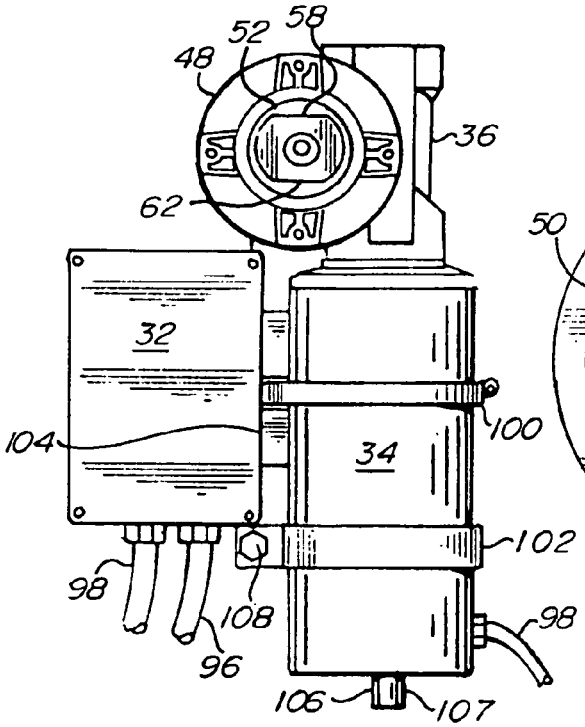
FIG. 3A is a side view of the boat lift drive of FIG. 1B.

FIG. 3A is a side view of the boat lift drive 30 and shows the control unit 32, power unit 34, and gear unit 36. A power cord 96 runs from the control unit 32. A jacket 98 carrying several electrical wires runs from the control unit 32 to the power unit 34. A first band connection 100 engages the generally cylindrical power unit 34 to the control unit 32. A second band connection 102 engages the generally cylindrical power unit 34 to the winch frame 18. First band connection 100 engages the back side of a U-shaped channel support 104 anchored to the control unit 32.

FIG. 3A also shows an end 106 of the motor shaft 107 driven by the power unit 34. The motor shaft 107 in power unit 34 drives the worm 40, which drives the worm gear 44, which drives the drive shaft 58 including the threaded interior portion 64. A conventional power hand drill can be secured to motor shaft end 106 and operated to rotate the drive shaft 58 onto winch shaft end 22 such that the boat lift drive 30 as a whole merely needs to be held in place, without turning on the boat lift drive 30 and while the boat lift drive 30 is disconnected from any power source, during set up operations to secure the boat lift drive 30 to the winch 14.

Figure 3B:
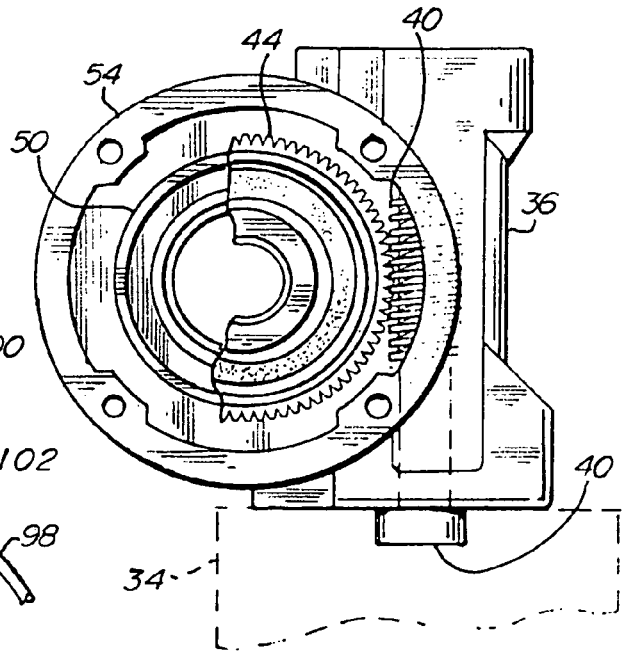
FIG. 3B is an end view of the gear unit of the boat lift of FIG. 1B, with the view being partially in section and having portions of the gear unit cut away.
Figure 3C:
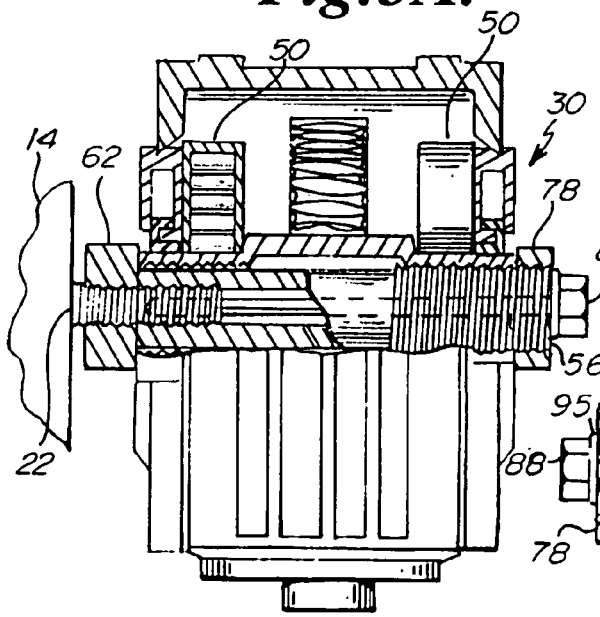
FIG. 3C is a side view of the gear unit of the boat lift of FIG. 1B, with the view being partially in section and having portions of the gear unit cut away, and with the view showing a portion of the winch including the end of the winch shaft.
Figure 3D:
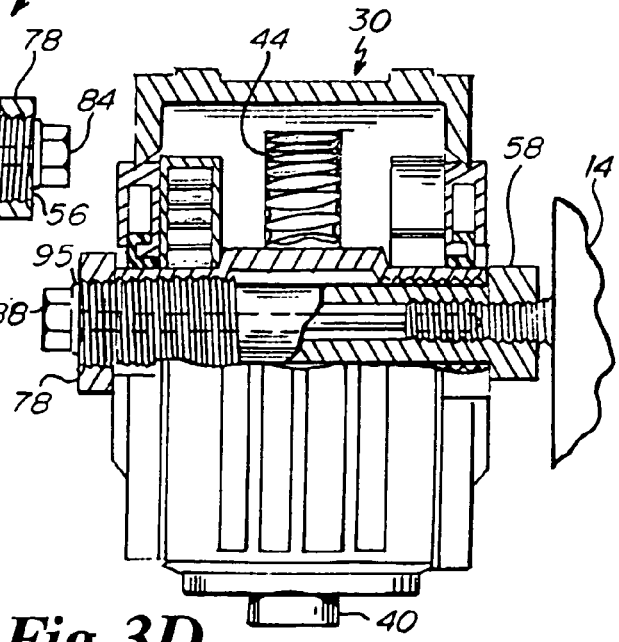
FIG. 3D is a view of the gear unit like the view of FIG. 3C except that the drive shaft is reversed such that the end of the drive shaft extends out the other end of the rotatable gear.

FIG. 3B shows engagement between the worm 40 and the worm gear or worm wheel 44. FIG. 3B further shows the drive shaft 58, core 46, bearing 50, and end face 54 of the worm gear housing 48.

FIGS. 3C and 3D show section views and demonstrate that the boat drive unit 30 may be fixed to the winch 14 with either of the faces of the boat drive unit 30 confronting the winch shaft end 22 and winch 14. One feature that contributes to this adaptability to various winches 14 and to the environment in and around the various winches 14 is the drive shaft 58 being threadable into core 46 from either of the ends of the core 46. Another feature that contributes to such an adaptability is that the control unit 32, power unit 34, and gear unit 36 are set in generally a common plane with each other, as shown by the perspective view of FIG. 1B. Another feature that contributes to such an adaptability is band connection 100. Band connection 100 permits, for example, the control unit 32 to be set 180 degrees opposite of that shown in FIG. 1B where the control unit 32, power unit 34, and gear unit 36 are again set in a generally common plane with each other. Further, if desired, band connection 100 permits fixing the control unit 32 at any one of 360 degrees relative to the power unit 34 and gear unit 36, any of which angles may facilitate fixing the boat lift drive 30 to any one of a various number of winches 14. Another feature that contributes to such adaptability is the band connection 102 that fixes the boat lift drive 30 to the winch 14. Band connection 102 includes a bolt 108 that may connect directly to a portion of the winch 14 or that may serve as a takeoff mount for a further support leading to the winch 14. Like band connection 100, band connection 102 may, prior to being fixed, rotate about cylindrical power unit 34, to place the bolt or takeoff mount 108 at any one of 360 degrees relative to the winch 14.

FIGS. 3C and 3D further show details of the gear unit 36. It can be noted that the drive shaft 58 has been screwed into the core 46 of the worm gear or rotatable gear 44. It can be noted that the worm gear 44 is pinched between the head 62 of the drive shaft 58 and the nut 78 of the drive shaft 58. Head 62 confronts the core 46 on one end of the worm gear 44 and nut 78 confronts the core 46 on the other end of the worm gear 44. It can be noted that the first end of the drive shaft 58, including the head 62, has been screwed onto the stub shaft or winch shaft end 22 of the winch 14. It can further be noted that pin 84 has been passed through the through opening of the drive shaft 58 and has been screwed into the winch shaft end 22.

In operation, first, to retrofit a winch 14 having a hand wheel 16, the hand wheel 16 is removed. Then the winch shaft end 22 is inspected and the appropriate drive shaft 58 and pin 84 is selected and hand turned on and off the winch shaft end 22 to insure that the selected drive shaft 58 and the selected pin 84 mate with the winch shaft end 22. Then the selected drive shaft 58 is screwed into core 46 and tightened thereon with the nut 78 and, if desired, a washer is placed between the nut 78 and the end of the core 46 that the nut 78 confronts. Here it should be noted that a conventional power hand drill may be fixed to the power shaft end 106 to turn the worm gear 44 and core 46 so as to draw the drive shaft 58 into the core 46 and tighten the nut 78 to a relatively high degree. Then boat lift drive 30 is lifted as a whole up to the level of the winch shaft end 22, whereupon band connection 102 may be fixed in a secure, albeit not immovable fashion, at a desired location to the winch frame 18 where the head 62 of the drive shaft 58 is in proximity with and generally coaxial with the winch shaft end 22. Then the conventional power hand drill may be used to again turn the motor shaft 107, which in turn drives the worm 40, which in turn drives the worm gear 44, which in turn drives the drive shaft 58 such that head 62 is screwed onto to the winch end shaft 22 until interior threaded portion 64 of the drive shaft 58 bites securely with exterior threaded portion 26 of the winch shaft end 22. Then the washer 95 is slid onto the pin 84, which in turn is passed through the through opening 74 of the drive shaft 58 and screwed into the winch shaft end 22 until the exterior threaded portion 92 of the pin 84 bites securely with the interior threaded portion 28 of the winch shaft end 22 such that the drive shaft 58 is locked onto the winch 14. Then band connection 102 may be tightened to a greater degree to the winch frame 18 to fix the boat lift drive 30 to the winch frame 18. Then the power cord 96 of the boat lift drive 30 may be plugged into an electrical socket. Then the boat lift drive 30 may be turned on via the key mechanism 38 to operate the winch 38 so as to lower the boat lift 12 (or portion thereof) into the water or raise the boat lift 12 (or portion thereof) out of the water. When the boat lift drive 30 is off, such as when the key mechanism 38 is turned off or such as when the power cord 96 is unplugged, winch 14 does not spool out. In other words, one or more of the winch 14 and gear assembly 36 individually or in combination, including the worm 40 and worm gear 44, prevents such spooling out. However, such as in the event of a power failure or such as in the event of an emergency, even when the key mechanism 38 is turned off or even when the power cord 96 is unplugged, motor shaft 107 may be operated in either of the directions of rotation by engaging the conventional power hand drill to the motor shaft end 106 so as to in turn rotate the drive shaft 58 and operate the winch 14.

It should be noted that winches 14, winch shafts 20, and winch shaft ends 22 have been manufactured in a variety of sizes, such as a variety of diameters, a variety of lengths, and a variety of thread pitches. FIG. 2 illustrates a winch shaft end 22 having a relatively short exterior threaded portion 26.

FIGS. 3C and 3D illustrate a winch shaft end 22 having a relatively long exterior threaded portion 26. Boat lift drive 30 can be sold as a kit, where the kit includes 1) a boat lift drive 30 including a control unit 32, a power unit 34, a gear unit 36 including a drive shaft 58, a nut 62, a washer for placement between nut 62 and the end of the core 46 that the nut 62 confronts, a pin 84, a lock washer 95, band connections 100, 102, 2) additional drive shafts 58 where the exterior threaded portion 70 remains diametrically the same for the core 46 but where the interior threaded portion 64 is of a different diameter or a different pitch so as to fit a different winch shaft end 22, and 3) additional pins 84 having a exterior threaded portion 92 of a different diameter or a different pitch so as to fit a different winch shaft end 22.

Figure 4A:
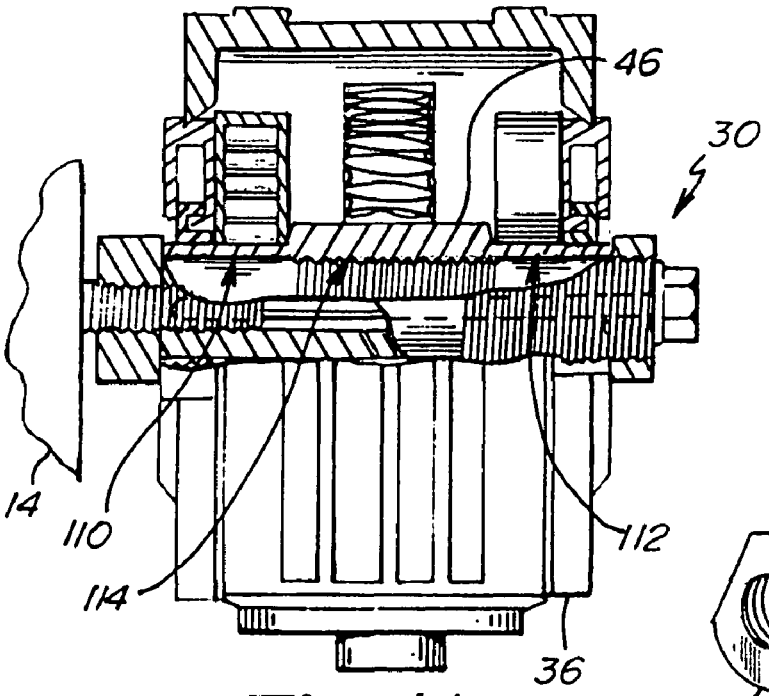
FIG. 4A is a view like the view of FIG. 3C, except that the gear unit includes a different core, with the different core including a medial threaded portion.
Figure 4B:
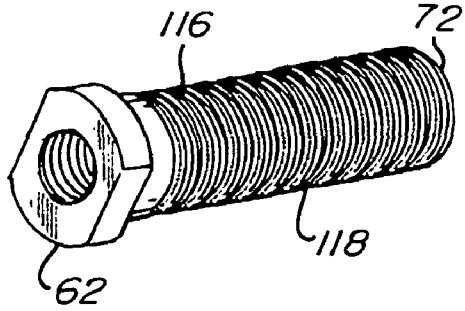
FIG. 4B is a perspective view of a drive shaft utilized for the gear unit and core of FIG. 4A.

FIG. 4A shows a different core 46 where the different core 46 includes an inner cylindrical portion having a first annular end section 110 that is free of threads and whose surface is smooth, a second annular end section 112 that is free of threads and whose surface is smooth, and an annular medial section 114 that is threaded to mate with a drive shaft 116 shown in FIG. 4B. The drive shaft 116 includes threads or an exterior threaded portion 118 that extends from face 72 to confront head 62.

Figure 4C:
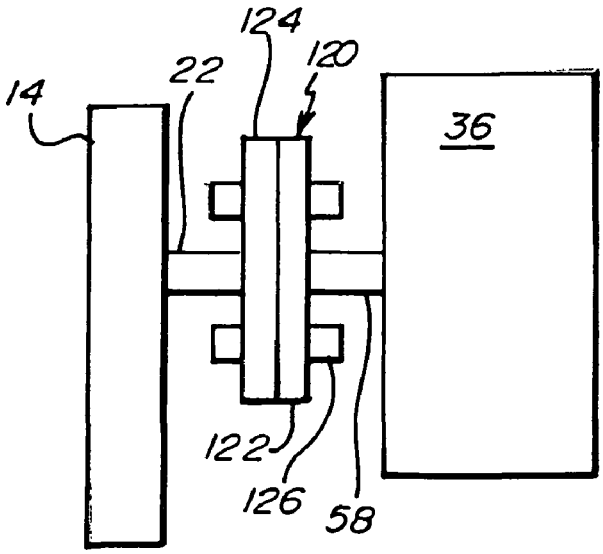
FIG. 4C is a diagrammatic view of an alternate embodiment of the present boat lift drive.

FIG. 4C is a diagrammatic view of an alternate embodiment of the invention where the drive shaft 58 includes head that is different from head 62. Here, drive shaft 58 includes a two-piece head 120 having a first head disk portion 122, a second head disk portion 124, and a set of bolts 126 engaging the portions 122, 124 together such that head portion 122 can drive head portion 124 in either of the directions of rotation. Head portion 124 includes an axial threaded opening to engage the winch shaft end 22 in the fashion of threaded interior portion 64 of drive shaft 58. In this embodiment, pin 84 may or may not be used to tie into winch shaft end 22.

In the embodiments shown in FIGS. 1B, 2, 3A, 3B, 3C, 3D, 4A, and 4B, the connections between drive shaft 58 and winch shaft end 22 are located at a minimal distance from the axis of rotation of the drive shaft 58 and winch shaft end 22 or, in other words, such distance is minimized. In still other words, such a connection is at a location that is at or near the common axis of the drive and winch shafts or a location that confronts the common axis of the drive and winch shafts. It is noted that the pin 84 includes the axis of rotation, where an axis is defined as a line about which an object rotates. In the embodiment of FIG. 4C, such distance is not minimized since the bolts 126 are spaced from the axis of rotation.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

We claim:

1. A boat lift drive for connection to a winch having a winch shaft, with the winch shaft including an end, with the end having an exterior threaded portion and an interior threaded portion, with the exterior threaded and interior threaded portions being coaxial with the winch shaft and with each other, with the interior threaded portion being a threaded opening, with the boat lift drive comprising:

a) a power unit;

b) a drive train engaged to and being driven by the power unit;

c) a drive shaft engaged to and being driven by the drive train, with the drive shaft being engaged to and driving the winch shaft, with the drive shaft comprising a first end and a second end, with the first end comprising an interior threaded opening that engages the exterior threaded portion of the end of the winch shaft whereby the drive shaft is directly connected to the winch shaft at an axial location of the drive and winch shafts.

2. The boat lift drive of claim 1, wherein the drive shaft further comprises a through opening between the first and second ends, with the second end comprising a face through which said through opening extends, and wherein the boat lift drive further comprises a pin extending through said through opening for further engaging said drive shaft to said winch shaft, with the pin having a proximal end and a distal end, with the proximal end comprising a head having a diameter greater than the diameter of said through opening at said face and with the head of the pin confronting said face of said second end, and with the distal end of the pin being threaded and engaging the interior threaded portion of the winch shaft to further engage the drive shaft to the winch shaft.

3. The boat lift drive of claim 1, wherein the first end of the drive shaft comprises a head, wherein the second end of the drive shaft comprises an exterior threaded portion, wherein the drive train comprises a rotatable gear having a through opening, and wherein the boat lift drive further comprises a nut having an interior threaded portion and a face, with said drive shaft extending through said through opening of said rotatable gear, with the head of the first end of the drive shaft confronting said rotatable gear, with the interior threaded portion of the nut engaging the exterior threaded portion of the second end of the drive shaft, and with the face of the nut confronting said rotatable gear to lock the rotatable gear between the first and second ends of the drive shaft such that the drive shaft is locked to said rotatable gear and to said boat lift drive.

4. The boat lift drive of claim 1, wherein the drive shaft comprises a threaded portion, wherein the drive train comprises a rotatable gear having a through opening, with said through opening comprising an interior threaded portion, and with the threaded portion of the drive shaft engaging said interior threaded portion of said rotatable gear.

5. A boat lift drive for connection to a winch having a winch shaft, with the winch shaft including an end, with the end having an exterior threaded portion and an interior threaded portion, with the exterior threaded and interior threaded portions being coaxial with the winch shaft and with each other, with the interior threaded portion being a threaded opening, with the boat lift drive comprising:

a) a power unit;

b) a drive train engaged to and being driven by the power unit, with the drive train comprising a rotatable gear, with said rotatable gear comprising a through opening that includes an interior threaded portion;

c) a drive shaft engaged to and being driven by the drive train, i) with the drive shaft being engaged to and driving the winch shaft, ii) with the drive shaft comprising a first end, a second end, and a through opening between the first and second ends, iii) with said first end of the drive shaft comprising a head and an interior threaded opening portion that is part of said through opening of said drive shaft, with said interior threaded opening portion engaging the exterior threaded portion of the end of the winch shaft whereby the drive shaft is directly connected to the winch shaft at locations that confront an axis of the drive and winch shafts, with said head of said first end of the drive shaft confronting said rotatable gear;

iv) with said second end of the drive shaft comprising a face through which said through opening of the drive shaft extends; and v) with said drive shaft further comprising a exterior threaded portion between said head and said face of said second end, with said exterior threaded portion of the drive shaft engaging said interior threaded portion of said through opening of said rotatable gear;

d) a nut, with the nut having an interior threaded portion and a face, with the interior threaded portion of the nut engaging the exterior threaded portion of the drive shaft and with the face of the nut confronting the rotatable gear such that the rotatable gear is engaged between said nut and said head of the drive shaft; and e) a pin extending through said through opening of said drive shaft and being engaged to said winch shaft, with said pin having a proximal end and a distal end, with said proximal end comprising a head having a diameter greater than a diameter of said through opening at said face of said second end of the drive shaft and with said head of the pin confronting said face of said second end of the drive shaft, and with said distal end of the pin being threaded and engaging the interior threaded portion of the winch shaft to further engage the drive shaft to the winch shaft.

6. A boat lift drive for connection to a winch having a winch shaft, with the winch shaft including an end, with the end having an exterior threaded portion and an interior threaded portion, with the exterior threaded and interior threaded portions being coaxial with the winch shaft and with each other, with the interior threaded portion being a threaded opening, with the boat lift drive comprising:

a) a power unit;

b) a drive train engaged to and being driven by the power unit;

c) a drive shaft engaged to and being driven by the drive train, with the drive shaft being engaged to and driving the winch shaft, with the drive shaft comprising a first end and a second end and a through opening between the first and second ends, with the first end comprising an interior threaded opening that engages the exterior threaded portion of the end of the winch shaft whereby the drive shaft is directly connected to the winch shaft, with the second end comprising a face through which said through opening extends; and d) a pin extending through said through opening for further engaging said drive shaft to said winch shaft, with the pin having a proximal end and a distal end, with the proximal end comprising a head confronting said face of said second end of the drive shaft, and with the distal end of the pin being threaded and engaging the interior threaded portion of the winch shaft to further engage the drive shaft to the winch shaft.

* * * * *